US008212646B2

(12) United States Patent
Crane et al.

(10) Patent No.: US 8,212,646 B2
(45) Date of Patent: Jul. 3, 2012

(54) FUSES

(75) Inventors: Allan David Crane, Warwickshire (GB); Christopher John Dunne, Leicester (GB)

(73) Assignee: Converteam Technology Ltd., Warwickshire (GB)

( * ) Notice: Subject to any disclaimer, the term of this patent is extended or adjusted under 35 U.S.C. 154(b) by 260 days.

(21) Appl. No.: 12/478,903

(22) Filed: Jun. 5, 2009

(65) Prior Publication Data

US 2009/0315664 A1 Dec. 24, 2009

(30) Foreign Application Priority Data

Jun. 16, 2008 (GB) ..... 0810953.0

(51) Int. Cl.
*H01H 85/42* (2006.01)
*H01H 85/38* (2006.01)

(52) U.S. Cl. ..... 337/278; 337/273

(58) Field of Classification Search ..... 337/182, 337/281, 273, 278
See application file for complete search history.

(56) References Cited

U.S. PATENT DOCUMENTS

| | | | | | |
|---|---|---|---|---|---|
| 1,227,385 | A | * | 5/1917 | Case | 337/281 |
| 1,889,585 | A | * | 11/1932 | Zodrow et al. | 337/293 |
| 2,216,661 | A | * | 10/1940 | Dannenberg | 337/224 |
| 2,427,181 | A | * | 9/1947 | Baskerville et al. | 337/6 |
| 2,556,018 | A | * | 6/1951 | Von Hoorn | 337/233 |
| 2,654,012 | A | * | 9/1953 | Cellerini | 218/26 |
| 2,734,110 | A | * | 2/1956 | Jacobs, Jr. | 337/281 |
| 2,757,261 | A | * | 7/1956 | Lingal et al. | 218/68 |
| 3,002,071 | A | * | 9/1961 | Storsand | 337/158 |
| 3,183,330 | A | | 5/1965 | Barkan et al. | |
| 3,452,174 | A | | 6/1969 | Carroll et al. | |
| 3,515,829 | A | * | 6/1970 | Hurtle et al. | 218/31 |
| 3,713,065 | A | * | 1/1973 | Brichant | 337/166 |
| 3,810,063 | A | | 5/1974 | Blewitt | |
| 4,019,006 | A | * | 4/1977 | Strossner | 218/156 |
| 4,032,879 | A | * | 6/1977 | Monagan | 337/278 |
| 4,038,626 | A | * | 7/1977 | Haydu et al. | 337/4 |
| 4,143,256 | A | * | 3/1979 | Ciarcia | 218/151 |
| 4,401,870 | A | | 8/1983 | St-Jean | |
| 5,793,275 | A | * | 8/1998 | Iversen | 337/273 |
| 6,100,491 | A | | 8/2000 | Moldovan | |
| 2006/0096954 | A1 | * | 5/2006 | Shea et al. | 218/157 |
| 2008/0277382 | A1 | * | 11/2008 | Chen et al. | 218/151 |

FOREIGN PATENT DOCUMENTS

| | | | |
|---|---|---|---|
| CH | 342273 | A | 11/1959 |
| DE | 2434897 | A1 | 2/1976 |
| GB | 28199 | A | 0/1912 |
| GB | 2020113 | A | 11/1979 |

* cited by examiner

*Primary Examiner* — Anatoly Vortman
(74) *Attorney, Agent, or Firm* — Eckert Seamans Cherin & Mellott, LLC; David C. Jenkins

(57) ABSTRACT

The present invention relates to a fuse assembly for rapid interruption of a prospective fault current. The fuse assembly includes a plurality of splitter plates. A plurality of foil elements extend between a pair of terminals and are physically supported by the splitter plates. A pair of parallel busbars are in series with the foil elements and generate a magnetic field that is substantially perpendicular to the current flowing in the foil elements. In the presence of a prospective fault current, the foil elements will melt and at arcing inception an electromagnetic force developed as a result of interaction between the magnetic field and the arc current will push the molten foil elements into the splitter plates. This increases the arc length and hence the arc voltage. At least the foil elements and the splitter plates are preferably located in flowing liquid dielectric such as MIDEL 7131, for example. The liquid dielectric flow may help to push the molten foil elements into the splitter plates and removes debris away from the arc site.

22 Claims, 3 Drawing Sheets

FUSES

CROSS REFERENCE TO RELATED APPLICATION

This application claims priority to UK Patent Application No. 0810953.0 filed Jun. 16, 2008.

FIELD OF THE INVENTION

The present invention relates to fuses, and in particular to fuses for rapid circuit interruption.

SUMMARY OF THE INVENTION

The present invention provides a fuse assembly comprising a plurality of substantially parallel electrically non-conducting splitter plates extending substantially along a longitudinal axis of the fuse assembly, at least one fusible conductor element, and means for generating a magnetic field that is substantially perpendicular to the current flowing in the at least one fusible conductor element and substantially parallel to the longitudinal axis of the fuse assembly.

The fuse assembly is preferably designed to carry a high nominal current and to be extremely robust against external factors such as shock and temperature. The fuse assembly provides rapid circuit interruption for unacceptably high currents such as currents in the order of three times the nominal current, although it will be readily appreciated that any prospective fault current may be much greater than this in practice.

The fuse assembly can be used as part of an ac or dc circuit. In other words, the at least one fusible conductor elements can be designed to carry an ac or dc current depending on the intended use of the fuse assembly.

The fuse assembly is physically compact and has acceptably low power losses.

To achieve such a physically compact fuse assembly it is generally preferred that the splitter plates and the at least one fusible conductor element are immersed in a liquid dielectric such as a proprietary transformer insulating fluid like MIDEL 7131, for example. The liquid dielectric improves cooling and the generation of arc voltages as described in more detail below.

It is anticipated that the fuse assembly might be fully integrated with electrical machines and power converters to provide the following technical benefits:

(i) fault current and torque transient limitation in low impedance electrical machines that use high temperature superconducting (HTS) windings or other forms of excitation in conjunction with electromagnetic shields or other low impedance damper structures;

(ii) permanent magnet de-magnetisation mitigation in high speed, high power density permanent magnet generators or other permanent magnet electrical machines that normally operate close to the performance limits of their magnets;

(iii) graceful degradation of electrical machines that employ an "active" stator (i.e. having an electronic commutator circuit using static power electronics that provides the designer with greater flexibility to increase performance and where the power electronics are modular and fully integrated within the electrical machine, sharing cooling systems, ancillary systems, structures and enclosures to achieve a high power density) and power converters in general;

Such technical benefits may be realised by a fuse assembly that occupies a small fraction of the space occupied by conventional fuses and at low cost.

The at least one fusible conductor element may be physically supported by the splitter plates. More particularly, the at least one fusible conductor element may be received in a slot formed in each of the splitter plates.

The fuse assembly will normally have a plurality of fusible conductor elements. In this case, the fusible conductor elements are preferably arranged in parallel and spaced apart from each other. Each fusible conductor element may be received in a respective slot formed in each of the splitter plates. Each fusible conductor element may have the same overall shape and configuration. The number and type of fusible conductor elements will depend on the desired operating characteristics of the fuse assembly. For example, the continuous thermally limiting current rating of the fuse assembly will be approximately proportional to the number of fusible conductor elements of a particular type employed. Also, the cross section or other geometric properties of the fusible conductor elements may be chosen to influence their interruption speed and this may impose a requirement to adjust the number of fusible conductor elements that are required in order to carry a particular continuous thermally limiting current.

The at least one fusible conductor element may include one or more regions for promoting localised heating as is well known in conventional fuse practice, but the cooling benefit provided by the present invention allows the more extensive use of this practice. These regions (which may also be thought of as regions having reduced cooling) may be implemented in several different ways. For example, the at least one fusible conductor element may be manufactured to include one or more "necks" of reduced width. Such a neck may be provided by an opening, recess or slot in the at least one fusible conductor element. Reduced cooling may also be provided at one or more locations along the length of the at least one fusible conductor element by applying ceramic beads to its outer surface or by receiving the at least one fusible conductor element in a respective slot formed in each of the splitter plates.

The or each region for promoting localised heating will have a negligible effect when the nominal current is flowing through the at least one fusible conductor element. In practice, it is expected that the or each region for promoting localised heating will be at substantially the same temperature as the rest of the at least one fusible conductor element during normal operation. However, the or each region will assist in defining where a molten neck will occur in the at least one fusible conductor element when an unacceptably high current flows through the at least one fusible conductor element as described in more detail below. More particularly, it is expected that a molten neck will correspond generally to a region for promoting localised heating.

The or each fusible conductor element may be similar to those used in conventional fuses. A foil element will generally be preferred to a circular wire element because it has improved cooling as a result of its high surface area to volume ratio. This means that for the same nominal current rating a foil element can have a smaller cross sectional area than a circular wire element, leading to a faster interruption time when the fuse assembly is activated by an unacceptably high current.

As described in more detail below, the splitter plates subdivide the arc that is developed during the activation of the fuse assembly into several sub arcs. The splitter plates therefore have the primary effect of increasing the arc length and hence increasing the arc resistance and voltage. The splitter plates also have a secondary effect of providing cooling and quenching of the arc but this may be insignificant when compared to the cooling effect of the liquid dielectric. The splitter plates may be formed from insulated metal plates or an insulation material such as epoxy mica, NOMEX or a suitable ceramic. The number of splitter plates will depend on the desired operating characteristics of the fuse assembly. The geometric properties of the at least one fusible conductor element may be arranged so as to cause sub arcs to be initiated midway between splitter plates and thus the number of sub arcs and splitter plates are directly linked. In general, the sum of the sub arc voltages will increase pro rata with the number of sub arcs and splitter plates; the number of splitter plates therefore being chosen on the basis of the external voltage that causes the prospective fault current to flow. To some degree, the number of splitter plates and the overall length of the at least one fusible conductor element are also chosen on the basis of the voltage that will be re-applied across the fuse assembly during and following interruption of the fault current, it being a requirement to avoid re-strike. The spacing of the splitter plates influences the overall length of the at least one fusible conductor element that is required in order for the sum of the sub arc voltages to be of a satisfactory level. In general, a reduction in the spacing of the splitter plates causes the ratio of total arc voltage per fusible conductor element to increase, subject to a minimum applicable spacing where there would be a risk of failure of the sub arcs to be deflected into the spaces between the splitter plates.

The deflection of sub arcs into the regions between the splitter plates is a result of the interaction between a magnetic field and the current that flows in the sub arcs. The nominal current rating of the fuse assembly will govern the number of fusible conductor elements that will be used in parallel.

The means for generating a magnetic field may include a pair of busbars that are preferably aligned in parallel with one another but are connected in series with the at least one fusible conductor element. The busbars are used to connect the fuse assembly to an external device or component that is to be protected.

The magnetic field generated by the pair of busbars and experienced between the busbars extends substantially perpendicular to both the longitudinal axis of the busbars and the axis of current flow in the fusible conductor elements. Interaction between the current flowing through the at least one fusible conductor element during normal operation of the fuse assembly and the magnetic field produces a resultant force on the at least one fusible conductor element that acts to push the at least one fusible conductor element towards the splitter plates. The resultant force therefore helps to retain the at least one fusible conductor element within the slot formed in each of the splitter plates where appropriate.

When the fuse assembly is activated then a similar interaction between the arc current and magnetic field will produce a resultant force that pushes the arc (together with any molten material and arc residue) into the splitter plates.

The busbars may be substantially parallel or arranged to diverge from one another to improve the deflection of the arc into the splitter plates.

A pair of coils (e.g. blowout coils) may also be connected in series with the single or parallel connected array of fusible conductor elements and are preferably located on either side of the fuse assembly to supplement the magnetic field generated by the current flowing in the busbars.

The fuse assembly may include at least one auxiliary fusible conductor element in parallel with the at least one fusible conductor element. The fuse assembly will normally have a plurality of auxiliary fusible conductor elements. In this case, the fusible conductor elements are preferably arranged in parallel and spaced apart from each other. Each auxiliary fusible conductor element may be associated with a fusible conductor element and may be received in the same respective slot formed in an end of each of the splitter plates as its associated fusible conductor element. Each auxiliary fusible conductor element may have the same overall shape and configuration. The number of auxiliary fusible conductor elements will depend on the desired operating characteristics of the fuse assembly.

The at least one auxiliary fusible conductor element will normally have a smaller cross sectional area than the at least one fusible conductor element and may conveniently employ a circular cross section. The relatively small cross section of the at least one auxiliary fusible conductor element allows it be formed with a greater physical length than the at least one fusible conductor element. The at least one auxiliary fusible conductor element may therefore follow a serpentine or arcuate path that extends between the splitter plates.

The at least one auxiliary fusible conductor element will have a lower current density than the at least one fusible conductor element as a result of its serpentine or arcuate path and correspondingly increased electrical resistance when compared with an auxiliary fusible conductor element that followed the straight path of the at least one fusible conductor element. This means that when the fuse assembly is activated by the flow of an unacceptably high current, the at least one auxiliary fusible element will only start to melt once the melting of the at least one fusible conductor element is well under way. The addition of the at least one auxiliary fusible conductor element acts to limit the current flowing in the at least one fusible conductor element and the arc voltage at the time of its arcing inception. The at least one auxiliary fusible conductor element therefore forces the mean arc current path to move further into the splitter plates, which enhances the magnetic deflection and increases the rate at which the effective arc length increases. The at least one auxiliary fusible conductor element will also increase the rate at which the arc voltage increases and the overall peak arc voltage that is developed during the activation of the fuse assembly.

The at least one fusible conductor element preferably extends between mounting plates or terminals. In the case where the fuse assembly includes a pair of busbars for generating the magnetic field then each busbar is preferably mounted to a respective one of the mounting plates.

If the fuse assembly is immersed in a liquid dielectric then it is generally preferred that the liquid dielectric flows past the at least one fusible conductor element and the splitter plates to provide improved cooling.

For example, the splitter plates may be secured within a housing and the fuse assembly may be located within a chamber that is at least partially filled with a liquid dielectric and which includes means (e.g. a fluid flow pump) for circulating the liquid dielectric so that it flows through the outer housing.

The housing may also form part of a duct for a cooling circuit (typically closed-loop) through which liquid dielectric flows. The cooling circuit may also be used to cool part of an external electrical machine or power converter, for example. The duct may be orientated to provide vertical flow of the liquid dielectric by natural convection or the liquid dielectric may be pumped through the duct. A combination of both methods may be used.

The direction of liquid dielectric flow will preferably be substantially parallel to the longitudinal axis of the fuse assembly such that the liquid dielectric flows past the at least one fusible conductor element and then through the spaces between the splitter plates. In other words, the at least one fusible conductor element is upstream and the splitter plates are downstream of the liquid dielectric flow.

A flowing liquid dielectric has the benefit of improving the cooling of the at least one fusible conductor element, which results in a shorter pre-arcing and total interruption time. The flowing liquid dielectric also assists in pushing the arc that is developed during an activation of the fuse assembly into the splitter plates—but this may be insignificant when compared to the effect of the magnetic deflection mentioned above—and transports any resulting arcing by-products and other debris (e.g. copper, carbon particles) away from the arc site. In a closed-loop cooling circuit, this debris must be separated by some sort of filtering or sedimentation means before the liquid dielectric is returned to the fuse assembly in order to eliminate the risk of a re-strike.

Means such as duct valving, for example, may be provided to ensure that any high pressure gas bubble created during the activation of the fuse assembly is directed into the splitter plates.

The activation of the fuse assembly will also create a pressure wave that must be accommodated in such as way as to guarantee the containment of the liquid dielectric within the chamber or duct.

The fuse assembly may also be immersed in a stationary liquid dielectric.

In the event of a prospective fault current being developed, an increase in the current flowing through the at least one fusible conductor element will causes the temperature of the at least one fusible conductor element to increase rapidly to the point where melting starts. The fuse assembly will then undergo four separate stages of operation, which are referred to here as "pre-arcing", "early arcing", "fully established arching and arc transport" and "post-arcing".

Pre-Arcing Stage

The at least one fusible conductor element will develop one or more molten necks, which may be deliberately promoted by providing the at least one fusible conductor element with one or more necks or other regions of localised heating. Melting will initially be centred at these regions and will propagate according to a conventional filamentation process.

As the at least one fusible conductor element starts to melt it will start to be pushed into the spaces between the splitter plates as a result of the magnetic deflection and, in a preferred embodiment, the action of the flowing liquid dielectric.

Early Arcing Stage

The filamentation process continues until the at least one fusible conductor elements becomes a series of molten globules. The fault current is no longer able to flow through the at least one fusible conductor element and arc columns form between the molten globules.

In a preferred embodiment, the flowing liquid dielectric in the area of the at least one fusible conductor element is vaporised and decomposes into a high pressure gas bubble that in the case of MIDEL 7131 is primarily hydrogen, some acetylene, methane and others. It is believed that the gas bubble causes a high arc voltage gradient to be developed.

The molten globules, the arc columns and any arcing by-products continue to be pushed into the spaced between the splitter plates as a result of the magnetic deflection and the action of the flowing liquid dielectric.

Fully Established Arcing and Arc Transport Stage

Individual arc columns between the molten globules quickly combine to form a single arc that is fully pushed into the spaces between the splitter plates to increase the arc length and cool the arc. This increases the arc voltage to a value that is well in excess of the forcing voltage that is causing the prospective fault current to develop. The arc voltage is intended to sharply limit the peak fault current to well below the maximum prospective level before it can damage the external device or component that the fuse assembly is designed to protect.

The arc is pushed into the spaces between the splitter plates as a result of the magnetic deflection and the action of the flowing liquid dielectric. However, the gas bubble may also assist in pushing the arc and means may be provided to direct the gas bubble into the splitter plates. Movement of the gas bubble through the liquid dielectric will create a pressure wave that must be accommodated in such as way as to guarantee the containment of the liquid dielectric.

The arc may leave the molten globules behind (i.e. they will be well outside the arc) as it moves into the splitter plates at high velocity.

Post-Arcing Stage

The rapid increase in the arc voltage causes the fault current to be chopped and arc voltage transients may result. It may therefore be necessary to use the fuse assembly in combination with a suitable snubber or other protective device.

The gas bubble of arcing by-products (still mainly hydrogen and acetylene) continues to move along the spaces between the splitter plates. Since there is no arc current, the movement of the gas bubble is entirely as a result of momentum and the normal flow of the liquid dielectric where appropriate.

If the fuse assembly is located in a closed-loop cooling circuit then the arcing by-products and other debris such as copper and carbon particles from the at least one fusible conductor element must be removed from the liquid dielectric to avoid the risk of a re-strike.

BRIEF DESCRIPTION OF THE DRAWINGS

Exemplary embodiments of the invention will now be described, with reference to the accompanying drawings, in which.

DETAILED DESCRIPTION OF THE PREFERRED EMBODIMENTS

Figure 1:
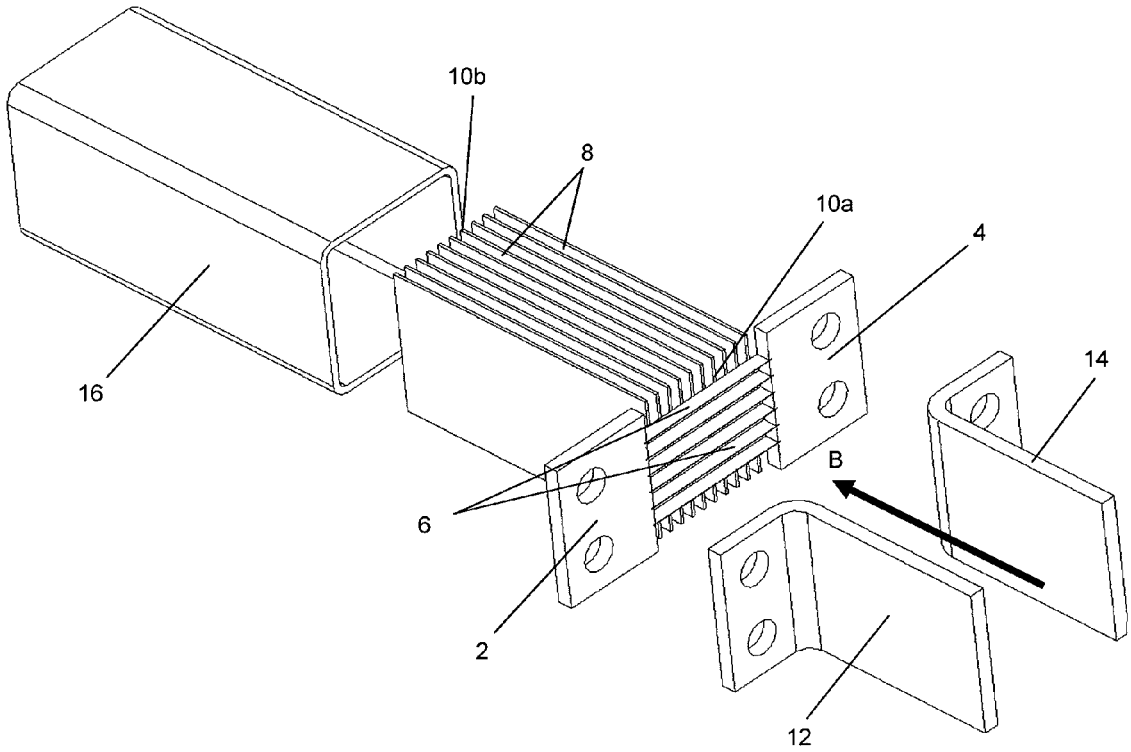
FIG. 1 is an exploded view showing the component parts of a fuse assembly according to the present invention.
Figure 2:
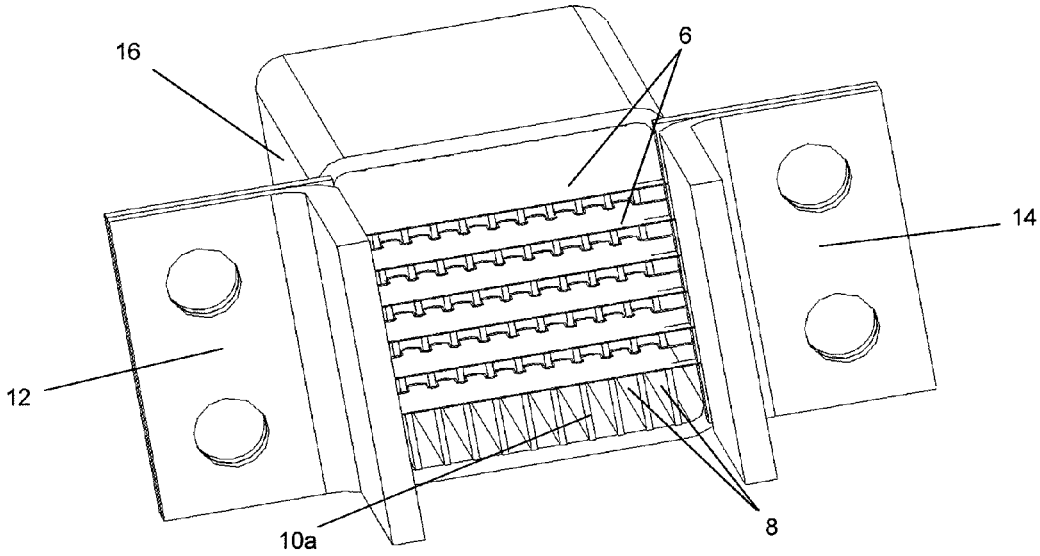
FIG. 2 is a view showing an end of the fuse assembly in its assembled state.

A fuse assembly having a nominal rating of circa 1000 A rms will now be described with reference to FIGS. 1 to 3.

The fuse assembly includes a pair of terminals 2, 4. Copper foil elements 6 extend between the terminals 2, 4 and carry a nominal current that is to be supplied to an external device or component (not shown) that the fuse assembly is designed to protect. Although six foil elements are shown in FIGS. 1 and 2, it will be readily appreciated that the number of foil elements will depend on the desired nominal rating of the fuse assembly. Each foil element is 5 mm wide, 0.25 mm thick and 50 mm long, but the shape and dimensions may be varied as appropriate.

A series of spaced-apart splitter plates 8 are arranged in parallel and have a first end 10*a* and a second end 10*b*. The splitter plates 8 are formed from a sheet of insulation material such as a mica epoxy or ceramic. Although ten splitter plates are shown in FIGS. 1 and 2, it will be readily appreciated that the number of splitter plates will depend on the desired interruption time of the fuse assembly. Each splitter plate is 1 mm thick and 50 mm wide, but the shape and dimensions may be varied as appropriate.

The foil elements 6 are received in slots provided in the first ends 10*a* of each of the splitter plates 8. More particularly, each splitter plate 8 has six slots formed in its first end 10*a* for receiving one of the foil elements 6 so that they are spaced apart from each other. The foil elements 6 are therefore physically supported by the splitter plates 8. In an alternative embodiment that is not illustrated, the foil elements may be spaced apart from the splitter plates so that an arc can be generated then stretched by diverging busbars before being split into a number of sub arcs by the splitter plates.

Busbars 12, 14 are mounted to the terminals 2, 4 so that they are connected in series with the foil elements 6. The busbars 12, 14 are connected to the external device or component (not shown) are secured to the terminals 2, 4 by bolts (not shown) that extend through the corresponding holes shown in FIGS. 1 and 2.

The busbars 12, 14 generate a magnetic field B that is perpendicular to the current flowing in the foil elements 6. The magnetic field B interacts with the current flowing in the foil elements 6 to produce a resultant force that acts to press the foil elements into the slots provided in the first ends 10*a* of the splitter plates 8. Although the busbars 12, 14 are parallel, they may optionally be shaped or configured to diverge from one another to force the arc up into the splitter plates 8 when the fuse assembly is activated by a prospective fault current.

The splitter plates 8 are secured within an outer housing 16 of mica epoxy to maintain their spacing.

Although not shown, the outer housing may be part of a duct for a closed-loop cooling circuit. In other words, the duct may continue to the right of the fuse assembly as shown in FIG. 1 between the busbars 12, 14. The terminals 2, 4 would extend through the duct and the busbars 12, 14 will be mounted to the terminals outside the duct. A liquid dielectric such as MIDEL 7131 is pumped through the duct from right to left as shown in FIG. 1. In other words, the first ends 10*a* of the splitter plates 8 are located upstream and the second ends 10*b* of the splitter plates are located downstream so that the liquid dielectric flows past the foil elements 6 which are thereby cooled, and along the spaces between the splitter plates.

The closed-loop cooling circuit may incorporate a pump for pumping the liquid dielectric, a filter for removing any debris from the liquid dielectric and some form of pressure relief system for accommodating the pressure wave that is generated by the activation of the fuse assembly.

Figure 3:
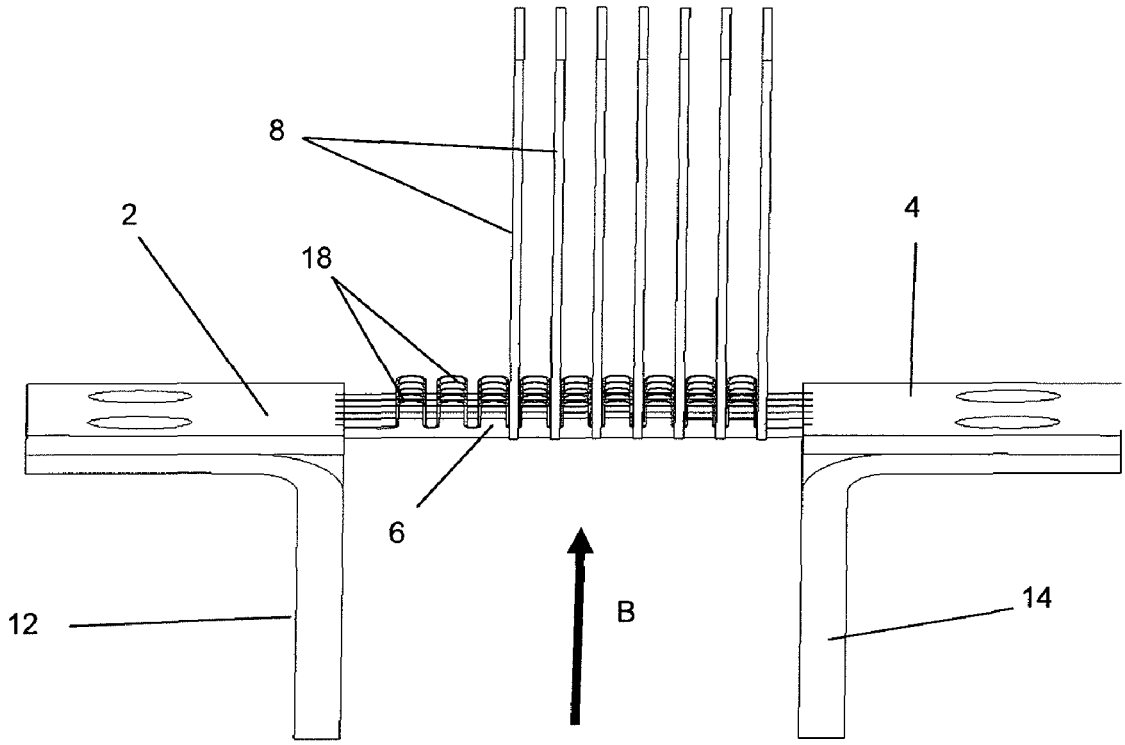
FIG. 3 is a detail view showing the arrangement of the splitter plates with main and auxiliary fusible conductor elements of the fuse assembly.

FIG. 3 shows how the fuse assembly is optionally provided with auxiliary circular wire elements 18 of smaller cross sectional area than the main foil elements 6. The auxiliary elements 18 follow a serpentine or arcuate path. More particularly, the auxiliary elements 18 are received in the slots formed in the first ends 10*a* of the splitter plates 8 and extend in a loop a small way along the splitter plates. It will therefore be readily appreciated that the auxiliary elements 18 are longer than the foil elements 6 which extend directly between the terminals 2, 4. The auxiliary elements 18 have a lower current density than the foil elements 6 and, in the presence of a fault current, will only start to melt once the melting of the foil elements is well under way.

The auxiliary elements 18 provide the technical benefits by:

(i) limiting the current flowing in the foil elements 6 during pre-arcing and early arcing stages;

(ii) limiting the arc voltage between the series of molten globules during an early arcing stage;

(iii) causing the mean arc current path to move further into the splitter plates 8 during a fully established arching and arc transport stage, thereby enhancing the magnetic deflection and increasing the rate of growth of effective arc length; and (iii) increasing the rate at which the arc voltage increases and the overall peak arc voltage that is developed during the fully established arcing and arc transport stage.

Figure 4:
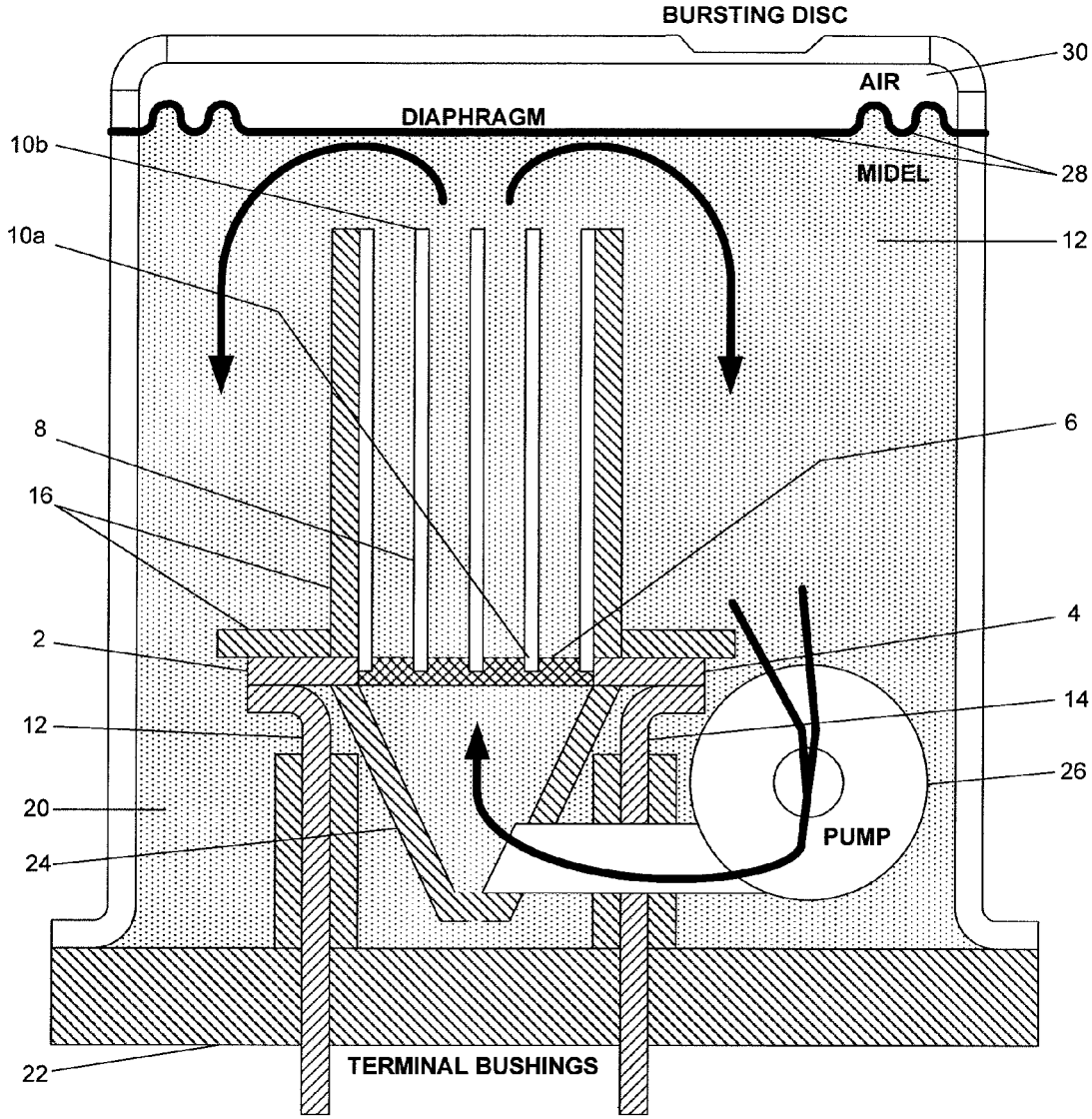
FIG. 4 is a view showing a self-contained fuse assembly according to the present invention.

FIG. 4 shows a self-contained fuse assembly where the foil elements 6, splitter plates 8 and outer housing 16 are located in a chamber 20 that is filled with a liquid dielectric such as MIDEL 7131. The busbars 12, 14 are mounted to the terminals 2, 4 and extend through a casing 22 for connection with the external device or component (not shown). A frusto-conical housing part 24 is provided on the opposite side of the foil elements 6 from the outer housing 16 and all three component parts are joined by a liquid-tight seal (not shown). A pump 26 circulates the liquid dielectric through the outer housing 16 as indicated by the arrows. More particularly, the pump 26 draws in liquid dielectric from outside the outer housing 16 and pumps it into the frusto-conical housing part 24. The liquid dielectric then flows past the foil elements 6, which are thereby cooled, and along the spaces between the splitter plates.

A diaphragm 28 defines an air-filled chamber 30 that can be compressed so as to accommodate the otherwise uncontrolled increased pressures generated by the activation of the fuse assembly to guarantee containment of the liquid dielectric.

The frusto-conical housing part 24 is designed to direct the high pressure gas bubble that is created by the decomposition of the liquid dielectric when the fuse assembly is activated towards the splitter plates 8.

In the event that a prospective fault current is developed then the temperature of the foil elements 6 increases rapidly to the point where melting starts. If necks have been provided in the foil elements 6 during their manufacture then molten necks will develop at these points along the length of the foil elements. Alternatively, molten necks may develop in the foil elements 6 at the points where the foil elements are received in the slots formed in the first ends 10*a* of the splitter plates 8 and where localised heating is promoted.

Melting will propagate according to a conventional filamentation process.

As the foil elements 6 start to melt they are pushed into the spaces between the splitter plates 8 as a result of the magnetic deflection provided by the interaction between the magnetic field generated by the current flowing in the busbars 12, 14 and the current in the foil elements 6, and the action of the flowing liquid dielectric.

The filamentation process continues until the foil elements 6 become a series of molten globules. The fault current is no longer able to flow through the foil elements 6 and arc columns form between the molten globules. The liquid dielectric is vaporised by the arc columns and decomposes into a high pressure gas bubble.

The individual arc columns between the molten globules will quickly combine to form a single arc that is fully pushed into the spaces between the splitter plates 8 by the magnetic deflection and the action of the flowing liquid dielectric. The gas bubble may also assist in pushing the arc and means such as the frusto-conical housing 24 are preferably provided to make sure that the gas bubble is directed towards the splitter plates 8. Pushing the arc into the splitter plates 8 has the effect of increasing the arc voltage to a value that is well in excess of the forcing voltage that is causing the prospective fault current to develop. The fuse assembly therefore provides a rapid interruption of the prospective fault current before the external device or component (not shown) is damaged.

What is claimed is:

1. A fuse assembly comprising:

a plurality of substantially parallel electrically non-conducting splitter plates extending substantially along a longitudinal axis of the fuse assembly;

at least one fusible conductor element;

at least one auxiliary fusible conductor element in parallel with the at least one fusible conductor element, wherein, in the event of a fault condition, the at least one auxiliary fusible conductor element structured to start to melt only after the at least one fusible conductor element starts to melt; and wherein the splitter plates, the at least one fusible conductor element and the at least one auxiliary fusible conductor element are immersed in a liquid dielectric.

2. A fuse assembly according to claim 1, wherein the at least one fusible conductor element is supported by the splitter plates.

3. A fuse assembly according to claim 1, wherein the at least one fusible conductor element is received in a slot formed in an end of each of the splitter plates.

4. A fuse assembly according to claim 1, further comprising a plurality of fusible conductor elements.

5. A fuse assembly according to claim 4, wherein each fusible conductor element is received in a respective slot formed in an end of each of the splitter plates.

6. A fuse assembly according to claim 1, wherein the at least one fusible conductor element includes one or more regions for promoting localized heating.

7. A fuse assembly according to claim 6, wherein the or each region for promoting localized heating is defined by a neck of reduced width formed in the at least one fusible conductor element.

8. A fuse assembly according to claim 1, wherein the at least one fusible conductor element is a foil element.

9. A fuse assembly according to claim 1, wherein the splitter plates are insulated metal plates.

10. A fuse assembly according to claim 1, wherein the splitter plates are formed from an insulation material.

11. A fuse assembly according to claim 1:

further comprising a means for generating a magnetic field that is substantially perpendicular to the current flowing in the at least one fusible conductor element and substantially parallel to the longitudinal axis of the fuse assembly; and the means for generating a magnetic field comprises a pair of busbars that are connected in series with the at least one fusible conductor element.

12. A fuse assembly according to claim 11, wherein the pair of busbars are substantially parallel.

13. A fuse assembly according to claim 1, wherein the at least one auxiliary fusible conductor element follows a serpentine or arcuate path that extends between the splitter plates.

14. A fuse assembly according to claim 13, wherein the at least one auxiliary fusible conductor has a smaller cross sectional area than the at least one fusible conductor element.

15. A fuse assembly according to claim 11:

further comprising mounting plates; and wherein the at least one fusible conductor element extends between the mounting plates.

16. A fuse assembly according to claim 15, wherein each busbar is mounted to a respective one of the mounting plates.

17. A fuse assembly according to claim 1, wherein the splitter plates are located within an outer housing through which a liquid dielectric is made to flow.

18. A fuse assembly according to claim 17, wherein the outer housing is part of a duct for a cooling circuit.

19. A fuse assembly according to claim 1, further comprising means for directing a high pressure gas bubble created during activation of the fuse assembly into the splitter plates.

20. A fuse assembly according to claim 17, further comprising means for directing a high pressure gas bubble created during activation of the fuse assembly into the splitter plates.

21. A fuse assembly according to claim 1 wherein the at least one fusible conductor element follows a generally linear path and wherein the at least one auxiliary fusible conductor element has a smaller cross sectional area than the at least one fusible conductor element and follows a non-linear path, whereby the at least one auxiliary fusible conductor element has a greater physical length than the at least one fusible conductor element.

22. A fuse assembly according to claim 1 wherein the at least one auxiliary fusible conductor element has a circular cross section.

* * * * *